US006195914B1

(12) United States Patent
Otis

(10) Patent No.: US 6,195,914 B1
(45) Date of Patent: Mar. 6, 2001

(54) SHOE WITH ADJUSTABLE UPPER

(75) Inventor: Jon Otis, Long Branch, NJ (US)

(73) Assignee: E.S. Originals, Inc., New York, NY (US)

( * ) Notice: Subject to any disclaimer, the term of this patent is extended or adjusted under 35 U.S.C. 154(b) by 0 days.

(21) Appl. No.: 09/352,268

(22) Filed: Jul. 13, 1999

(51) Int. Cl.[7] ..... A43B 3/12; A43B 23/00

(52) U.S. Cl. ..... 36/11.5; 36/45; 36/88

(58) Field of Search ..... 36/11.5, 97, 45, 36/88, 50.1, 93

(56) References Cited

U.S. PATENT DOCUMENTS

| | | | | |
|---|---|---|---|---|
| 2,226,110 | * | 12/1940 | Bass | 36/11.5 |
| 2,981,010 | * | 4/1961 | Aaskov | 36/11.5 |
| 3,410,004 | * | 11/1968 | Finn | 36/93 |
| 3,871,116 | * | 3/1975 | Vanderlinden | 36/11.5 |
| 4,106,222 | * | 8/1978 | Houck | 36/11.5 |
| 4,112,599 | * | 9/1978 | Krippelz | 36/11.5 |
| 5,343,638 | * | 9/1994 | Legassie et al. | 36/88 |

* cited by examiner

*Primary Examiner*—M. D. Patterson
(74) *Attorney, Agent, or Firm*—Kirschstein, et al.

(57) ABSTRACT

An adjustable upper is inflated to accommodate the size of a wearer's foot. The upper is formed with a plurality of inflatable passages that grip the foot with a non-slipping, cushioned fit.

7 Claims, 1 Drawing Sheet

FIG. 1
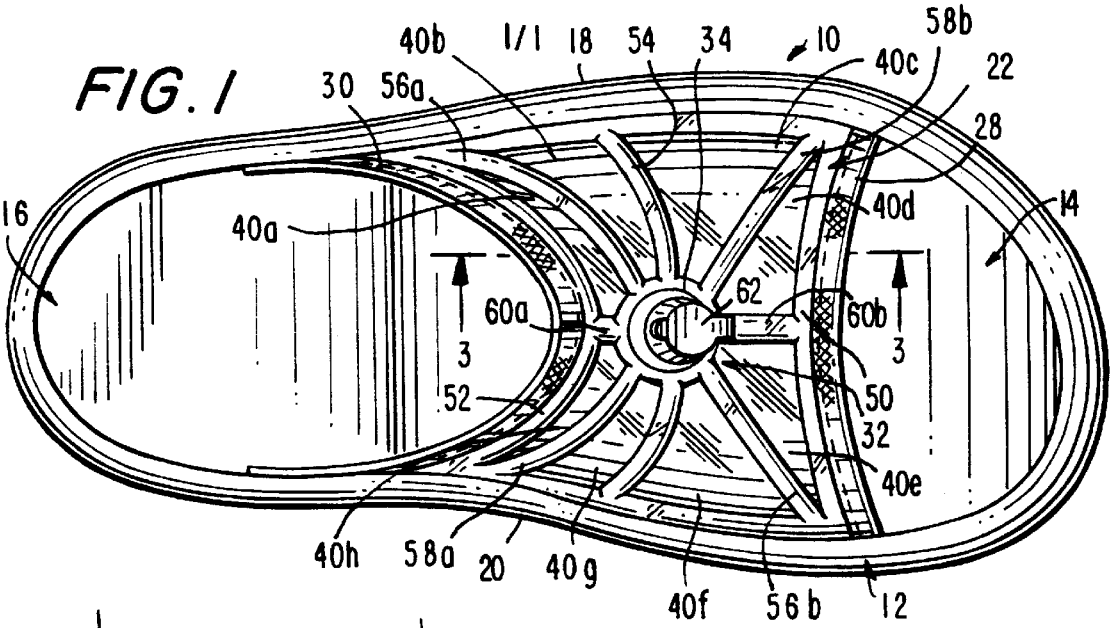
FIG. 2
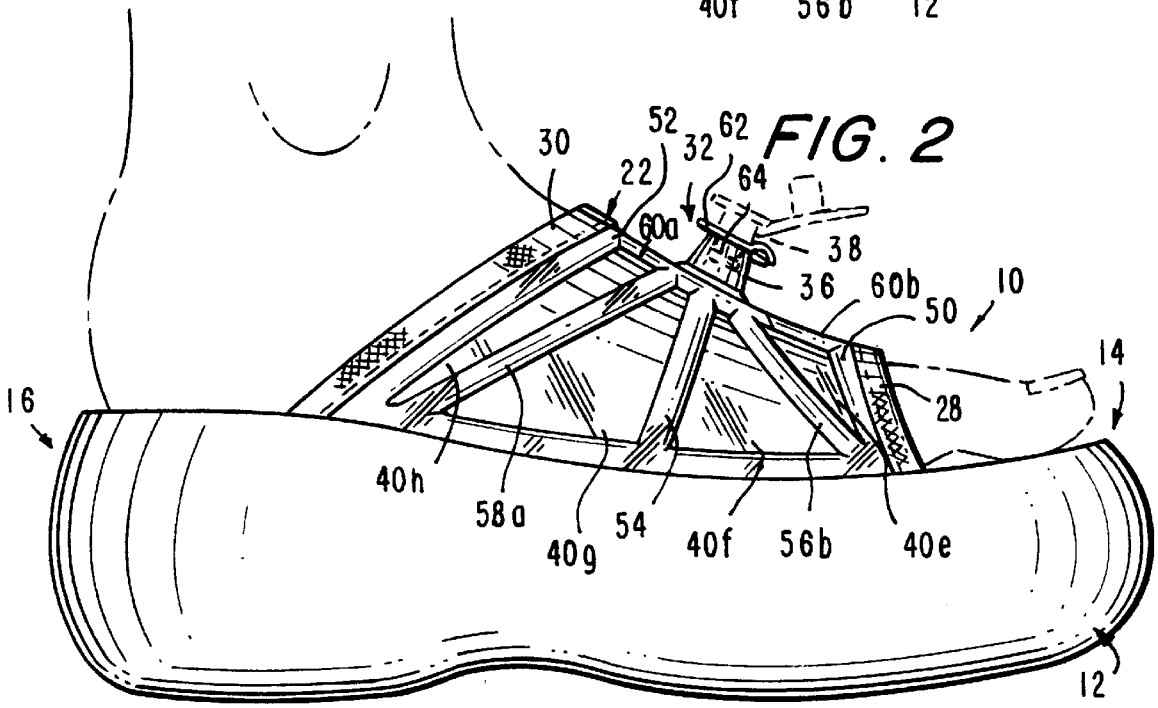
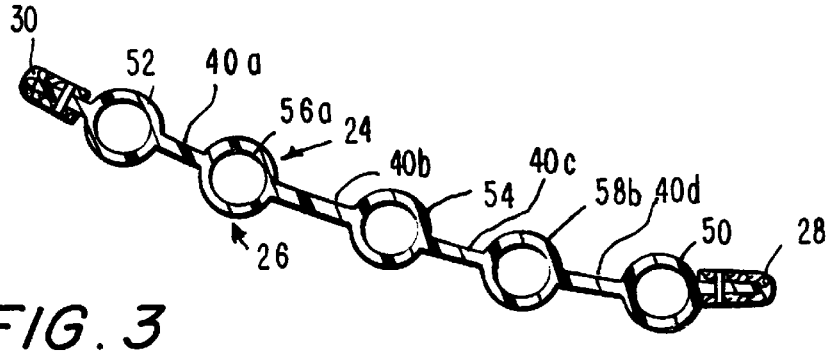
FIG. 3

SHOE WITH ADJUSTABLE UPPER

BACKGROUND OF THE INVENTION

1. Field of the Invention

This invention generally relates to fitting a shoe on a wearer's foot and, more particularly, to adjusting an upper of the shoe to accommodate the size of the wearer's foot.

2. Description of the Related Art

Shoes are manufactured in multiple graduated sizes to enable a wearer to select the best fit. Yet, once a shoe size is selected, the selected size is fixed, and the wearer must seek comfort in the fixed size despite the fact that the wearer's foot changes in size over time, and typically even over the course of a day.

To provide some measure of adjustability, the art has suggested the placement of removable inserts and discrete inflatable bladders within the shoe. The inserts are generally positioned outside the interior shoe lining and, due to their removability, are prone to becoming dislodged and lost. The discrete bladders are generally placed inside the upper and its lining and sometimes inside the shoe tongue. These bladders are usually inflated by a manually operated pump and, although generally satisfactory for their intended purpose, are costly to manufacture and assemble in the shoe.

SUMMARY OF THE INVENTION

Objects of the Invention

Accordingly, it is a general object of the present invention to provide a shoe upper whose size is readily adjustable.

Still another object of the present invention is to provide an adjustable upper which is integrated into the shoe.

A still further object of the present invention is to reduce the costs of manufacture and assembly of the shoe.

Features of the Invention

In keeping with these objects and others which will become apparent hereinafter, one feature of this invention resides, briefly stated, in a shoe having a sole for supporting a bottom of a wearer's foot. The sole has opposite lateral sides and is preferably constituted of a wear-resistant material. The shoe also has an adjustable upper secured to the sole. The upper spans over a top of the wearer's foot between the sides of the sole. The upper has a pair of outer and inner layers of flexible material bounding an interior space. Preferably, the layers are constituted of a synthetic plastic, heat-fusible material.

In accordance with this invention, an inlet is mounted on the upper and is in fluid communication with the space for filling the space with a fluid and concomitantly moving at least one of the layers toward the sole to engage the top of the wearer's foot. The more fluid that is introduced into the space, the greater the movement of the one layer, and the more snug the engagement of the upper with the top of the wearer's foot. A closure, such as a plug, is operative to close the inlet to resist the escape of fluid from the space.

In order to insure a reliable, firm, non-slipping engagement between the upper and the wearer's foot, the space is subdivided into a plurality of passages arranged as follows. A forward, arch-shaped passage at a forward region of the upper and a rear, arch-shaped passage at a rear region of the upper are spaced apart, as considered lengthwise of the sole, to grip the wearer's foot at both these forward and rear regions from one side of the sole along curved, generally semi-circular paths to the other side of the sole. An intermediate, arch-shaped passage at an intermediate region of the upper between the forward and rear regions adds still another generally semi-circular gripping surface to resist slippage between the upper and the wearer's foot.

The passages further include interconnecting passages that extend between, and interconnect, the forward and rear passages. In the preferred embodiment, the inlet is centrally located on the upper at a central region, and the interconnecting passages extend outwardly from the central region in generally radial directions to the front and rear passages.

The outer and inner layers are preferably fused together at select areas. The areas that are not fused together constitute the aforementioned passages. Preferably, all the passages are in fluid communication with the inlet.

The inlet includes a plurality of tubular sections that collapse, when pressed, to a generally flattened configuration that lies against the upper. The plug is tethered to one of the sections to prevent its loss. The inlet preferably includes a self-closing, one-way valve to permit entry of fluid in an inward direction, but which prevents escape of the fluid in an outward direction. The plug is for additional sealing safety.

A pair of binding strips is folded over and connected to respective forward and rear edges of the upper. The strips are made of a soft, flexible cloth to resist scratching of the wearer's foot against the otherwise-exposed, harder plastic edges of the upper.

In use, the wearer repetitively exhales into the inlet until the passages of the upper are inflated to a desired extent. The outwardly bulging passages snugly engage the wearer's foot. The fused-together areas of the layers, that is, the areas between the bulging passages, follow more closely over the outer surface of the wearer's foot for increased comfort and fit. The extent of inflation is adjustable whenever desired.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side elevational view of a shoe with an adjustable upper in accordance with this invention;

FIG. 2 is a top plan view, on an enlarged scale, of the shoe of FIG. 1 after inflation; and FIG. 3 is a sectional view as taken along the line 3—3 of FIG. 2.

DETAILED DESCRIPTION OF THE PREFERRED EMBODIMENT

Referring now to the drawings, reference numeral 10 generally identifies a shoe having a sole 12 for supporting a bottom of a wearer's foot shown in phantom lines in FIG. 1. The sole 12 has a toe portion 14, a heel portion 16 and opposite lateral sides 18, 20 extending along opposite sides of the sole between the toe and heel portions. The sole can be made of many different rigid and non-rigid materials. Currently, rubber or plastic is preferred. The bottom surface of the sole is typically made of a wear-resistant material.

An adjustable upper 22 is secured to the sole and spans over a top of the wearer's foot between the sides 18, 20 of the sole. The upper 22 includes an outer sheet layer 24 facing away from the sole, and an inner sheet layer 26 facing toward the sole. The layers 24, 26 are juxtaposed and overlay each other.

The lateral edge regions of the layers 24, 26 at one side of the upper are anchored in side 18 of the sole. The lateral edge regions of the layers 24, 26 at the opposite side of the upper are anchored in side 20 of the sole. The front edge regions of the layers 24, 26 at a forward region of the upper that is spaced close to the toe portion 14 of the sole are covered by a front binding strip 28. The front edge regions of the layers 24, 26 at a rear region of the upper that is spaced close to the heel portion 16 of the sole are covered by a rear binding strip 30.

The layers 24, 26 are constituted of a flexible material, preferably a heat-fusible synthetic plastic material such as low density polyethylene. By application of heat and pressure, the layers 24, 26 are sealed together at predetermined areas. Thus, the lateral edge regions of the layers at each opposite side of the upper are fused together prior to being anchored in a respective side of the sole. Also, the front edge regions are fused together prior to being covered by the front strip 28, and the rear edge regions are fused together prior to being covered by the rear strip 30.

The upper forms a tunnel with the sole. As shown in FIG. 1, the wearer's foot is inserted and extends through the tunnel. The binding strips 28, 30 are preferably constituted of a soft cloth to prevent the foot from being scratched against the otherwise-exposed edges of the plastic layers 24, 26 during the insertion of the foot. The illustrated shoe is an open-backed sandal although, as the description proceeds, it will be recognized that other shoes, such as sneakers, may incorporate the adjustable upper of this invention.

The layers 24, 26 bound an interior space therebetween. An inlet 32 is mounted at a central region 34 of the upper and is in fluid communication with the interior space. As described below, a fluid, such as a gas exhaled by the wearer, is introduced via the inlet into the interior space to fill the space to a desired extent. At the same time, at least one of the layers, for example, inner layer 26, is moved toward the sole and engages the top of the wearer's foot. In effect, the tunnel gets smaller as the space is filled, thereby causing the upper to snugly grip the foot.

The layers 24, 26 are connected together, preferably by heat fusion, but also by other joining techniques, such as adhesion, at selected joined areas 40*a, b, c, d, e, f, g, h*. The layers 24, 26 lie in surface area contact and flat against each other at these joined areas. The layers at these joined areas flex and closely conform to the outer contour of the wearer's foot.

The non-joined areas between the layers 24, 26 constitute the aforementioned interior fillable space and are subdivided by the joined areas into a plurality of passages, such as arch-shaped front 50, rear 52 and intermediate 54, passages and interconnecting passages 56*a, b*, 58*a, b* and 60*a, b*, all of which are in fluid communication with one another and with the inlet 32 at the central annular hub region 34.

Front passage 50, rear passage 52 and intermediate passage 54 span the entire width of the upper between the sides 18, 20 of the sole and, when filled, bulge outwardly and have a generally circular cross-section, as seen in FIG. 3. The inner layer 26 makes a resilient, cushioned contact with the wearer's foot. The front passage 50 is closer to the toe portion 14, while the rear passage 52 is closer to the heel portion 16. The intermediate passage 54 extends through the hub portion 54. The series of three arch-shaped passages 50, 52, 54 spaced lengthwise of the sole provide a strong non-slipping grip on the foot.

Interconnecting passages 56*a*, 58*a* diverge outwardly away from each other from the hub region 34 to opposite ends of the rear passage 52. Interconnecting passages 56*b*, 58*b* diverge outwardly away from each other from the hub region 34 to opposite ends of the front passage 50. Interconnecting passages 60*a*, 60*b* extend lengthwise of the sole in opposite directions from the hub region 34 to the rear and front passages 52, 50. The passages 56*a*, 56*b*, on the one hand, and the passages 58*a*, 58*b*, on the other hand, criss-cross over the upper in an X-shaped pattern. The passages engage the foot at multiple angles and along multiple directions.

As best seen in FIG. 1, the inlet 32 has a plurality of tubular, collapsible sections 36, 38 of different diameter. A plug 62 is tethered to the smaller section 38 and is received in an open outer end thereof to close the inlet and resist the escape of the fluid from the interior space through the inlet. A force exerted against the plug 62 will push the smaller section 38 into the larger section 36 and, in turn, the larger section 36 will buckle and collapse within the upper. The result is that the plug 62 lies generally flat against the outer layer 24 and no projections extend outwardly from the upper.

In addition to, or instead of, the plug 62, a self-sealing, one-way valve 64 is mounted within the inlet. The valve 64 moves out of the way in response to pressure exerted by the incoming fluid, and automatically by its inherent resilience returns to its blocking position in which it prevents escape of fluid outwardly of the inlet.

In use, a person, typically the wearer, exhales into the valve a number of times until the upper is sufficiently inflated to a desired extent. The valve 64 prevents escape of the fluid between exhalations. If overinflated, the valve 64 can be pushed out of the way to deflate the upper. Once the desired size of the upper is achieved, the shoe is ready to be worn.

It will be understood that each of the elements described above, or two or more together, also may find a useful application in other types of constructions differing from the types described above.

While the invention has been illustrated and described as embodied in a shoe with an adjustable upper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A shoe, comprising:

a) a sole for supporting a bottom of a wearer's foot, the sole having opposite lateral sides spaced apart along a transverse direction;

b) an adjustable upper secured to the sole and spanning over a top of the wearer's foot between the sides of the sole, the upper including a forward region and a rear region spaced apart along a longitudinal direction perpendicular to the transverse direction, and an intermediate region located between the forward and rear regions, the upper including a pair of outer and inner, flexible material, layers sealed together at contact zones and bounding a plurality of tubular passages;

c) an inlet mounted on the intermediate region of the upper and being in fluid communication with the tubular passages for filling the tubular passages with a fluid, and a closure for closing the inlet to resist the escape of fluid from the tubular passages; and d) a forward one of the tubular passages at the forward region of the upper spanning over the top of the wearer's foot along the transverse direction between the sides of the sole, a rear one of the tubular passages at the rear region of the upper spanning over the top of the wearer's foot along the transverse direction between the sides of the sole, a side pair of the tubular passages at the sides of the sole extending along the longitudinal direction, and a group of radial tubular passages at the intermediate region of the upper spanning over the top of the wearer's foot from the inlet along radial directions to the forward and rear ones, and the side pair, of the tubular passages.

2. The shoe according to claim 1, wherein the layers are constituted of a heat-fusible synthetic plastic material, and wherein the contact zones are heat-fused areas.

3. The shoe according to claim 1, wherein the inlet includes a housing having collapsible tubular sections.

4. The shoe according to claim 3, wherein the closure is a plug tethered to one of the tubular sections.

5. The shoe according to claim 1, wherein the inlet includes a one-way valve.

6. The shoe according to claim 1; and a binding strip at each of the forward and rear regions.

7. The shoe according to claim 6, wherein each binding strip is constituted of a cloth material.

* * * * *